US009066555B2

(12) United States Patent
Holzer et al.

(10) Patent No.: US 9,066,555 B2
(45) Date of Patent: Jun. 30, 2015

(54) SPORTS SHOE WITH AN OUTER SHELL OF INJECTION MOULDED PLASTIC

(75) Inventors: Helmut Holzer, St. Johann (AT); Gerhard Trinkaus, Köflach (AT); Jason Roe, Wagrain (AT)

(73) Assignee: Atomic Austria GmbH (AT)

( * ) Notice: Subject to any disclaimer, the term of this patent is extended or adjusted under 35 U.S.C. 154(b) by 971 days.

(21) Appl. No.: 12/817,375

(22) Filed: Jun. 17, 2010

(65) Prior Publication Data

US 2010/0319220 A1 Dec. 23, 2010

(30) Foreign Application Priority Data

Jun. 17, 2009 (AT) ..... A 928/2009

(51) Int. Cl.

| | |
|---|---|
| ***A43B 5/04*** | (2006.01) |
| ***A43B 7/08*** | (2006.01) |
| ***A43B 7/12*** | (2006.01) |

(52) U.S. Cl.

CPC ..... *A43B 5/0415* (2013.01); *A43B 7/085* (2013.01); *A43B 7/125* (2013.01); *A43B 5/0427* (2013.01); *A43B 5/0496* (2013.01)

(58) Field of Classification Search

CPC .. A43B 5/0415; A43B 5/0496; A43B 5/0427; A43B 5/04; A43B 5/0409; A43B 7/085; A43B 7/125

USPC ..... 36/95, 115, 116, 117.1–117.9

See application file for complete search history.

(56) References Cited

U.S. PATENT DOCUMENTS

| | | | | |
|---|---|---|---|---|
| 6,112,435 | A | 9/2000 | Collavo | |
| 6,247,252 | B1 * | 6/2001 | Parisotto | 36/118.7 |
| 6,474,004 | B2 * | 11/2002 | Collavo | 36/119.1 |
| 7,377,058 | B2 * | 5/2008 | Elkington et al. | 36/117.6 |
| 7,430,818 | B2 * | 10/2008 | Valat et al. | 36/45 |
| 7,810,258 | B2 * | 10/2010 | Narajowski et al. | 36/117.2 |
| 2002/0004997 | A1 * | 1/2002 | Pizzamiglio et al. | 36/117.1 |
| 2002/0108272 | A1 * | 8/2002 | Parisotto | 36/117.1 |
| 2004/0211091 | A1 * | 10/2004 | Heierling et al. | 36/117.1 |
| 2006/0225306 | A1 * | 10/2006 | Rigat | 36/117.2 |
| 2008/0271345 | A1 * | 11/2008 | Narajowski et al. | 36/118.2 |

FOREIGN PATENT DOCUMENTS

| | | | |
|---|---|---|---|
| DE | 3429284 | A1 | 2/1986 |
| EP | 0894445 | A1 | 2/1999 |
| EP | 1074194 | A1 | 2/2001 |
| EP | 1571939 | A1 | 9/2005 |

(Continued)

*Primary Examiner* — Jila M Mohandesi

(74) *Attorney, Agent, or Firm* — Lerner, David, Littenberg, Krumholz & Mentlik, LLP

(57) ABSTRACT

The invention relates to a sports shoe with an outer shell of injection molded plastic, comprising a front foot shell for accommodating the front foot and an adjoining shoe cuff for stabilizing the lower leg portion of a user, and with a relatively flexible inner shoe at least partially accommodated in the shell. Disposed in the outer shell is at least one elastically flexible portion which is provided as a means of reducing pressure points from the inner shoe on a user's foot when subjected to compression stress. The elastically flexible portion is provided in the form of at least one membrane element which is designed to vary the volume or width which the shell can accommodate as a function of compression stress due to its slackness or ability to deflect relative to the surrounding part-portions of the shell.

15 Claims, 4 Drawing Sheets

(56) References Cited

FOREIGN PATENT DOCUMENTS

| | | | |
|---|---|---|---|
| JP | 5213933 | B2 | 2/1977 |
| JP | 11266903 | | 5/1999 |
| JP | 5096703 | B2 | 12/2012 |
| WO | 2004/052134 | A1 | 6/2004 |

* cited by examiner

SPORTS SHOE WITH AN OUTER SHELL OF INJECTION MOULDED PLASTIC

BACKGROUND OF THE INVENTION

The invention relates to a sports shoe with an outer shell of injection moulded plastic, of the type specified in the introductory part of claim 1.

A sports shoe of the generic type, in particular a ski or skate shoe, with a shell of plastic and a comparatively soft inner shoe is known from patent specification EP 0 894 445 A1. In this instance, the shell has at least one region with a rigidity which is lower than the rigidity of the rest of the shell. This region of low rigidity is a relatively flexible region on the external face and/or internal face of the shell and is provided in front of the metatarso-phalangeal joint of a foot when inserted in the shell. Based on a first embodiment, the shell is made from two plastics of differing rigidity and the more rigid plastic is used for the outside of the shell and the flexible region is defined by a cut-out in the rigid plastic, which is closed by a relatively soft plastic in the interior of the shell. These two plastics of differing rigidity or hardness are joined to an integral shell body during a dual injection moulding process. Based on a second embodiment, the flexible region of the sports shoe is again defined by a cut-out in the shell but the inner shoe has a plastic element on its outside which is less rigid than the shell and is disposed so that it closes the cut-out. The flexibility of the region of lower rigidity is selected so that this region is able to deform slightly when placed under pressure by the metatarso-phalangeal joint of the foot, thereby reducing pressure on this foot joint and preventing pain at this point as far as possible. The first embodiment is problematic in terms of the production technology and the degree of elasticity or flexibility which can be obtained is not very satisfactory. The second embodiment is primarily critical in terms of ensuring that the shell is sealed and prevents moisture from getting into the shoe interior.

Patent specification EP 1 571 939 A1 discloses a different design of sports shoe with a relatively rigid shell. In order to increase user comfort, this sports shoe has a plurality of windows or cut-outs in the outer shell, which are disposed on the outside and/or inside of the shoe so that they coincide with the bones and metatarsus. These orifices or cut-outs in the shell are overlapped by cushioning extending from the outer surface of the shell. This cushioning is made up of multi-layered parts made from different plastic materials and is secured to the external surface of the shell so that a sort of sandwich structure is created. A separate part-component of the shoe shell made from a rigid, impact-resistant material defines an externally lying protective plate for the peripheral edge portions of the relatively flexible cushioning element. In particular, the flexible cushioning is partially overlapped by the relatively rigid protective plate and the portion of the cushioning which covers the opening in the shoe shell is left exposed by the protective plate. The flexible cushioning is also attached to the outside of the shoe shell by the protective plate. The protective plate and the flexible cushioning are bigger than the cut-out or opening in the shell by a multiple. In the case of another embodiment, a sealing element made from a water-impermeable material is provided in addition to this sandwich-type cushioning to prevent water from seeping into the shoe or snow from penetrating it. This sealing element is fitted on the external surface of the shell and covers the respective cut-out in the shell. The seal element is in turn overlapped by the cushioning element mentioned above. This previously known design is also relatively complex to manufacture, resulting in high production costs. Furthermore, the compressible cushioning element is exposed to greater risk of damage or breakage at the surface, which may result in problems with regard to preserving the seal of the sports shoe.

BRIEF SUMMARY OF THE INVENTION

The underlying objective of this invention is to improve a sports shoe of the generic type so that it offers the user greater comfort, affords a reliable long-term seal to prevent undesirable penetration by moisture but can nevertheless be produced at the lowest possible cost.

This objective is achieved by the invention by means of a sports shoe incorporating the characterising features defined in claim 1.

One advantage of the sports shoe proposed by the invention resides in the fact that a membrane element is provided rather than a compressible cushioning element, which eliminates or reduces unpleasant pressure points on the respective user's foot due to its ability to move relative to the relatively rigid portions of the shoe. Accordingly, whilst producing only one design of shell body, allowance can be made for a plurality of different physiological foot shapes. This keeps manufacturing costs down because with a relatively small range of shell shapes, it is still possible to cater for a higher range of different foot shapes or foot widths. Independently of the above, it has been found that the foot gradually becomes wider with increasing use, especially towards the end of the day, and the sports shoe proposed by the invention is able to offer the user more comfort, even after longer periods of use. Also of particular advantage is the fact that the claimed design offers advantages in terms of production, in particular simplifications to the manufacturing process, whilst nevertheless guaranteeing the highest possible production quality. A reliable seal is also obtained, which prevents undesirable penetration by snow or liquids. Moreover, the overall weight of the sports shoe can be kept as low as possible because the relatively flexible and laterally deflectable membrane element does not add much extra weight to the relatively rigid shell body and even reduces the weight in the elastically flexible portion of the outer shell of the sports shoe.

The advantage of the embodiment defined in claim 2 is that the membrane skin may have properties which enable it to bend relatively loosely or flex and this membrane skin, which is flexible without the need for any particular force, together with the support body assumes a correct non-operating position or defined initial position. Furthermore, the flexible membrane skin, which may be provided in the form of a film for example, can be restricted in terms its maximum deflection or protected from excessive stress by the support body. This design also simplifies the production process because the corresponding membrane element, comprising the membrane skin and at least one support body for the membrane skin, can be defined by a prefabricated part-component for the subsequent sports shoe.

The membrane offers particularly effective functions as a result of the features defined in claim 3. In particular, these result in a relatively light adjustment of the membrane skin relative to the support body and relative to the shoe shell. Furthermore, an expedient adjustment range is obtained in a simple manner for varying the volume or width which the shoe shell can accommodate without unpleasant pressure points occurring at physiologically critical points of a user's foot.

The features defined in claim 4 also result in a relatively lightly adjustable design, thereby avoiding or reducing pressure points as far as possible. The specified designs are nevertheless sufficiently robust because the membrane skin can be attached to or retained on the support body extending round the circumferential region sufficiently securely to prevent it from being torn off or coming loose.

As a result of the features defined claim 5 or 6, the membrane skin is able to move relative to the shoe shell in a defined manner. Furthermore, the stress to which the material of the membrane skin is subjected can be kept as low as possible, resulting in a membrane element that will remain robust and impermeable to liquid for a long time. In particular, material fatigue and tearing during the standard product life can be virtually ruled out.

Also of particular advantage is another embodiment defined in claim 7, because it offers a simple way of ensuring that the relatively slack membrane skin assumes a defined initial shape or a predefined non-usage state. In addition, it is also possible to assist or produce elastically flexible resistance to oppose an adjusting movement of the membrane skin and restore the membrane skin to the predefined initial or non-usage shape. Alternatively or in combination with this, it is also possible to restrict the maximum adjustment in a simple manner by opting for a sort of stop element, thereby preventing or reducing stress to the membrane skin.

The additional features defined in claim 8 are conducive to an elastically flexible adjusting and restoring movement of the membrane skin. The robustness of the membrane element can also be increased as a result of this design because the at least one support element reduces the risk of damage to the membrane skin if subjected to external forces.

Also of advantage is an embodiment defined in claim 9 because a membrane skin of this type has a high degree of flexibility in terms of its shape and is also capable of withstanding high mechanical stress. In particular, the risk of tearing or over-stretching of such a membrane skin when subjected to loads and with respect to the requisite spatial extension of the membrane is minimal or negligible. Moreover, these features also result in a good heat insulating effect so that a pleasant climate can be created in the sports shoe for the foot, even at low temperatures.

The embodiment defined in claim 10 is of advantage because in spite of opting for a relatively thin, for example film-type, membrane skin, a pleasant and in particular dry climate for the foot can be guaranteed, even under inclement ambient conditions, for example in the presence of snow or dampness.

As a result of the embodiment defined in claim 11, the membrane skin coated with plastic and the support body for the membrane skin, likewise made from plastic, result in a relatively firm join that will not tear. In particular, a firm adhesive bond or fusion can be obtained between the plastic coating on the membrane skin and the support body made from plastic.

The features specified in claim 12 or 13 enable the membrane element to be manufactured by a simple and inexpensive production technique. They also result in a particularly tear-resistant and firm join between the membrane skin and support body of the membrane element because the membrane skin is welded to the support body, as it were.

With the embodiment defined in claim 14, use is made of the elastic expansion property, in other words the extensibility, of the material to obtain the corresponding change in the width or volume of the shoe shell. Furthermore, a tight seal of the membrane skin is achieved as a result because the sealing function is obtained due to the sealing properties intrinsic to the plastic, in particular the elastomer.

The features defined in claim 15 result in a robust join between the membrane element and shoe shell. Production is also made simpler. In addition, the seal between the membrane element and shell can also be guaranteed if the membrane element is inserted in the co-operating opening of the shell flush with the external surface of the shell and does not overlap or is not fitted on top of the external surface of the shell ring around the opening.

The production process used to manufacture the claimed sports shoe is made simpler because the membrane element is prefabricated separately in a downstream process and then defines a prefabricated part-portion of the shoe shell during the plastic injection moulding process used to produce the shoe shell. Moreover, a reliable seal is obtained between the circumferential portions of the membrane element and the transition or peripheral portions adjoining the actual shell body of the sports shoe.

Finally, the features are also of advantage because the width or volume of the basically hard plastic shell can be varied to a certain degree at those points of the sports shoe which can subject a user's foot to pressure under certain circumstances and this change in volume makes allowance for a plurality of users with different foot shapes or projecting bones. Due to the oval or egg-shaped circumferential contour of the membrane element, these deformation zones are limited to those portions in which a change in volume or width is of practical advantage whereas the remaining portions of the sports shoe remain hard and inflexible enough to enable force to be transferred efficiently from the user's foot to a sports device, for example a ski, a roller body or a runner.

BRIEF DESCRIPTION OF THE DRAWINGS

To provide a clearer understanding, the invention will be described in more detail below with reference to the appended drawings.

The simplified, schematic drawings illustrate the following.

DETAILED DESCRIPTION

Figure 1:
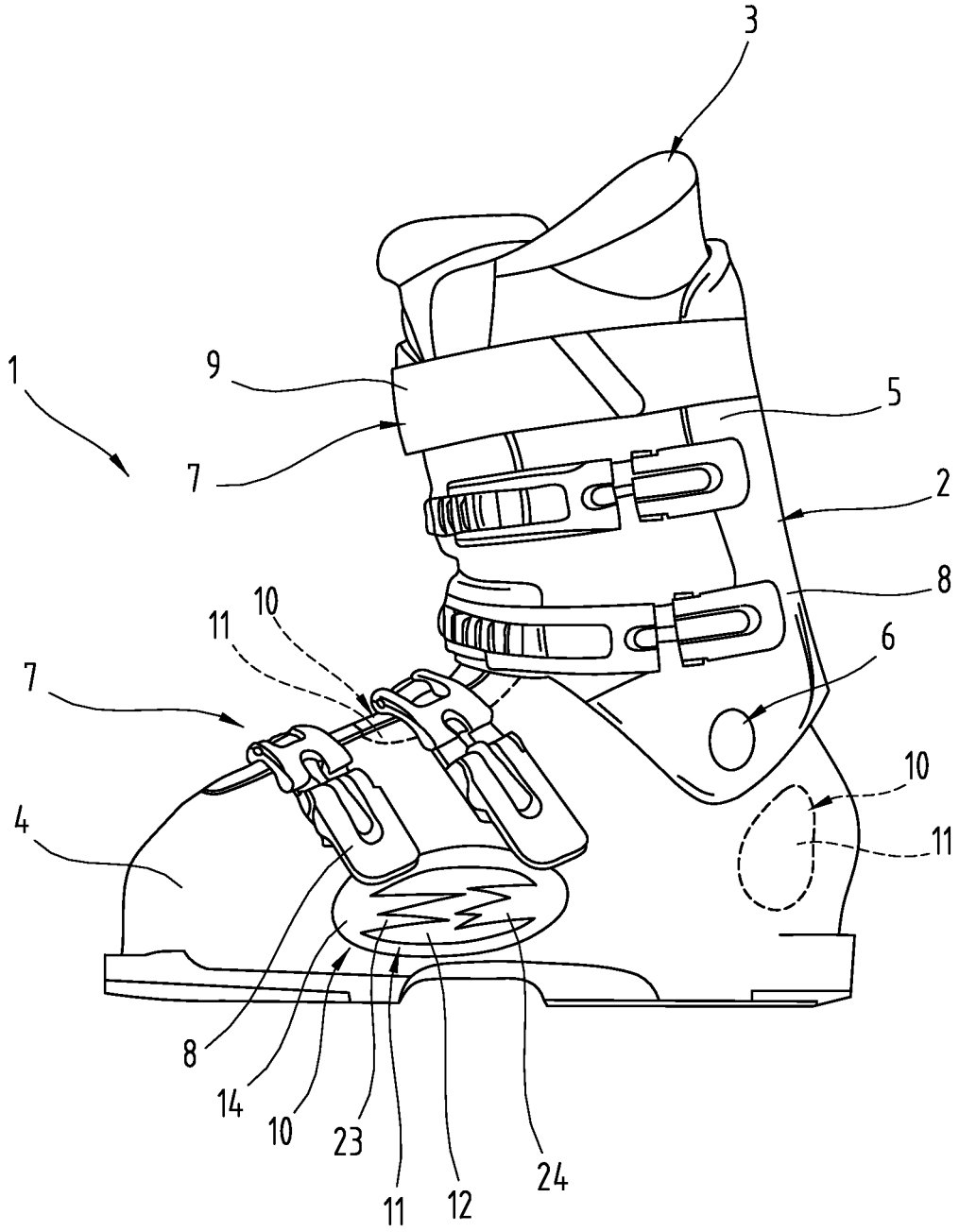
FIG. 1 is a sports shoe, in particular an alpine ski shoe, with at least one membrane element enabling the front foot shell to be varied as a function of compression stress.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 illustrates an embodiment of a sports shoe 1 of the generic type, with an outer shell 2 of injection moulded, relatively hard plastic and a relatively flexible inner shoe 3 at least partially accommodated in the outer shell 2. This sports shoe 1 is designed as a high shoe or boot. It comprises a front foot shell 4 for accommodating the front part of the foot and an adjoining shoe cuff 5 for stabilising a user's lower shin or leg portion. Typically, the sports shoe 1 is an alpine ski boot or touring ski shoe and it generally has a joint connection 6 between the front foot shell 4 and shoe cuff 5 in a manner known per se, the axis of which extends essentially parallel with the ankle or ankle joint of a foot inserted in the sports shoe 1. However, roller skate shoes or in-line skates or ice skate shoes also have a relatively hard and inflexible, outer shell and an inner shoe at least partially accommodated in it to improve comfort and performance.

To enable a foot to be held firmly in the sports shoe 1 on the one hand and to make it easier to step into and out of the sports shoe 1 on the other hand, its volume can be individually varied and adapted by means of at least one tensioning means 7, for example by means of at least one buckle 8 and/or at least one strap 9. Whilst the inner shoe 3 is primarily designed to embed the foot as comfortably as possible, the outer shell 2 is made from relatively hard and inflexible plastic and fulfils the function of transmitting force directly and with as little delay as possible between a user's foot and the ground underneath or a sports device. In order to avoid pressure points on the user's foot, it is necessary to strive for an optimum design between the shell 2, inner shoe 3 and foot, However, unpleasant pressure points still occur on the user's foot, due to an unsatisfactory fit on the one hand and individually varying foot shapes on the other hand. In particular, the bony projections in the region of the metatarsal bone and base of the toes and/or the bony projections in the region of the ankle joint can subject a user's foot to unpleasant pressure. Furthermore, it has been found that the shape of the foot changes the longer it is subjected to stress, especially towards the end of the day, and usually becomes wider, which can also lead to an unpleasant feeling.

To enable a plurality of individual foot shapes to be comfortably accommodated using only one shell shape, generic sports shoes 1 have been developed which have at least one elastically flexible portion 10 in the essentially stiff outer shell 2 which does not change shape. This at least one elastically flexible portion 10 in the outer shell 2 is provided at positions where potential pressure points can occur. In particular, the elastic portion 10 is disposed on the outside (FIG. 1) and/or on the inside (FIG. 2) of the front foot shell 4 and expediently on a level with the metatarso-phalangeal joint. Alternatively or in combination with this, an elastic, flexible portion 10 may be provided in the region of the instep of the front foot shell 4 (portion indicated by broken lines in FIG. 1 or 2) and/or in the shoe cuff 5, as well, coinciding with the ankle or ankle joint.

The elastically flexible portion 10 in the outer shell 2 is designed so that it reduces or prevents unpleasant pressure points on a user's foot from the inner shoe 3 when subjected to pressure. It is of particularly practical advantage if the elastically flexible portion 10 in the outer shell 2 is provided in the form of at least one membrane element 11. This membrane element 11 defines a boundary or wall portion of the shell 2, in particular the front foot shell 4 and/or the shoe cuff 5. In the embodiment illustrated as an example in FIG. 1, the membrane element 11 is an elastically flexible portion on the outer side wall of the front foot shell 4. In the embodiment illustrated as an example in FIG. 2, a membrane element 11 of a similar design is disposed on the inside of the front foot shell 4 of a sports shoe 1, in particular a ski shoe.

This at least one membrane element 11 is of a significantly higher slackness than the shell 2 and the membrane element 11 possesses a flexibility and ability to change shape which is significantly higher than that of the shell 2 which means that the membrane element 11 is able to deflect easily relative to the shell 2. An ability to deflect or move by up to 6 mm, usually approximately 3 mm, is enough to make allowance for the deformation and widening of the foot or front part of the foot which occur over longer periods of exposure to stress efficiently. The membrane element 11 is therefore provided as a means of changing the volume and width which the shell 2 can accommodate as a function of compression stress. The compression stress which occurs is transmitted from the inner shoe 3 or foot of the user to the membrane element 11. This means that in the case of the sports shoe 1 proposed by the invention, allowance can be made for gradually increasing foot widths and a plurality of individually varying foot widths and foot shapes.

Figure 2:
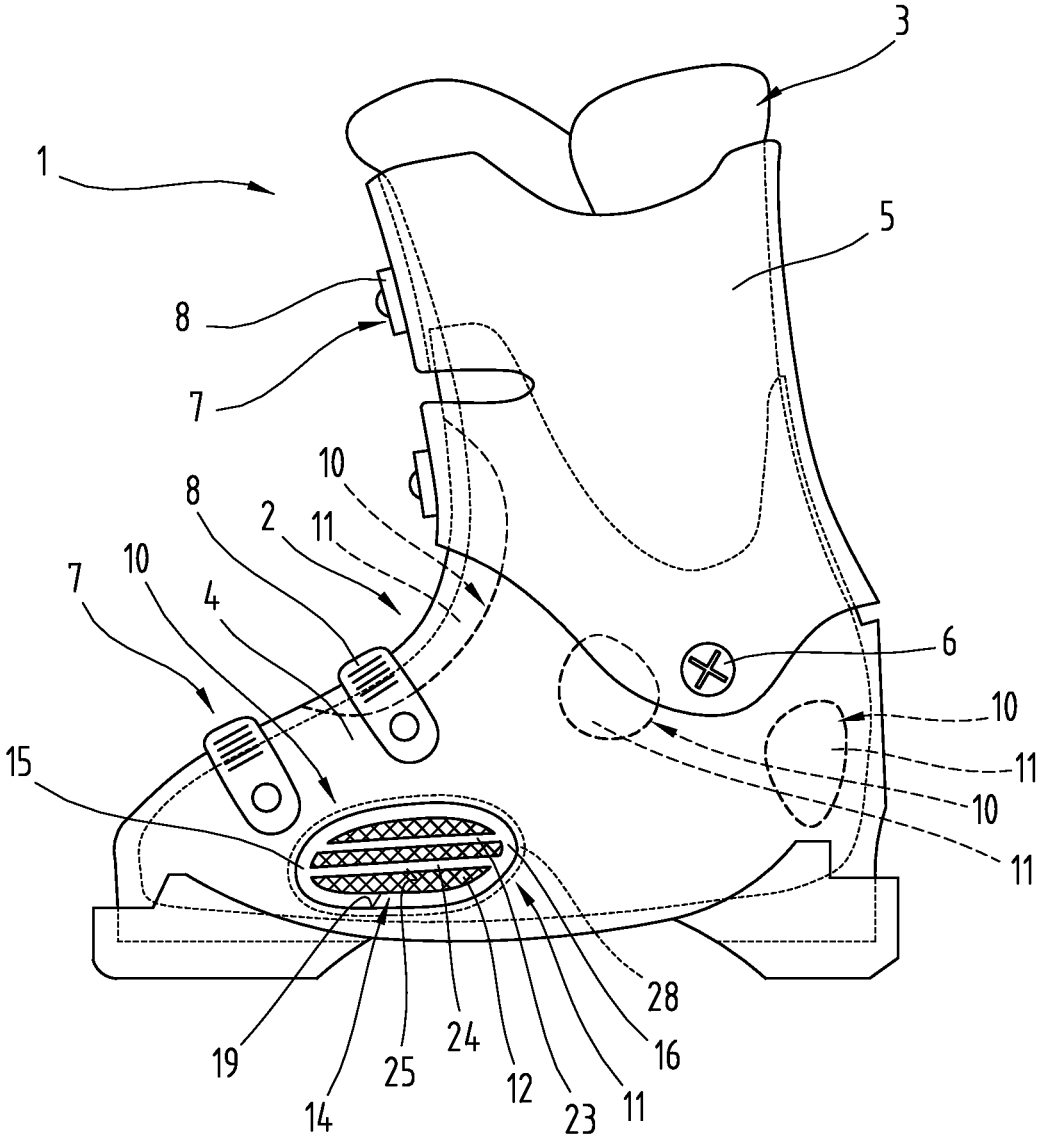
FIG. 2 is another embodiment of a sports shoe with a different design of at least one membrane element disposed on the internal face of the front foot shell.
Figure 3:
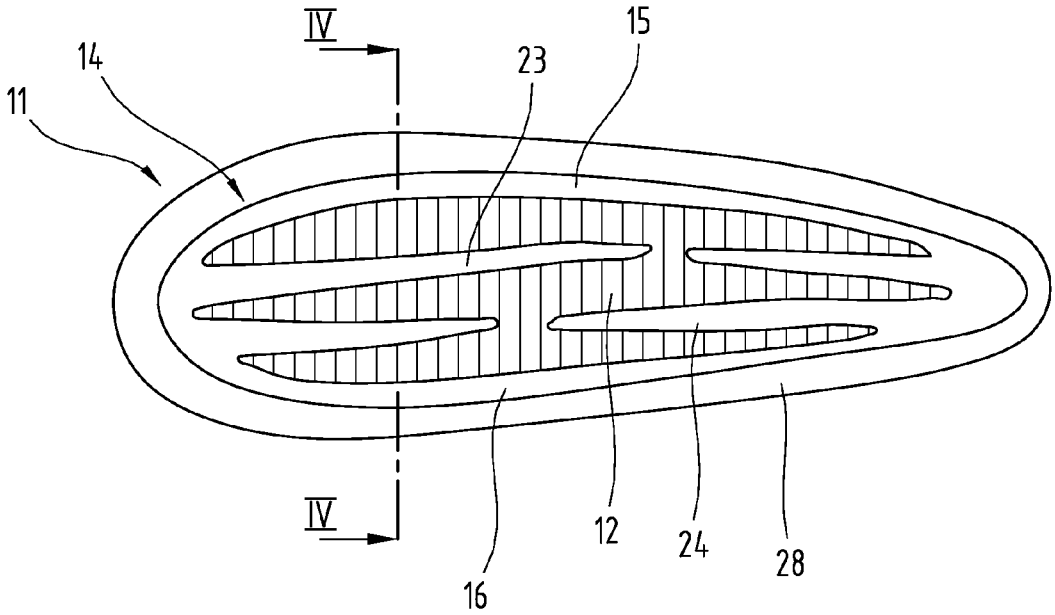
FIG. 3 is another embodiment of a membrane element for sports shoes which reduces pressure points, with a relatively hard outer shell of injection moulded plastic.
Figure 4:
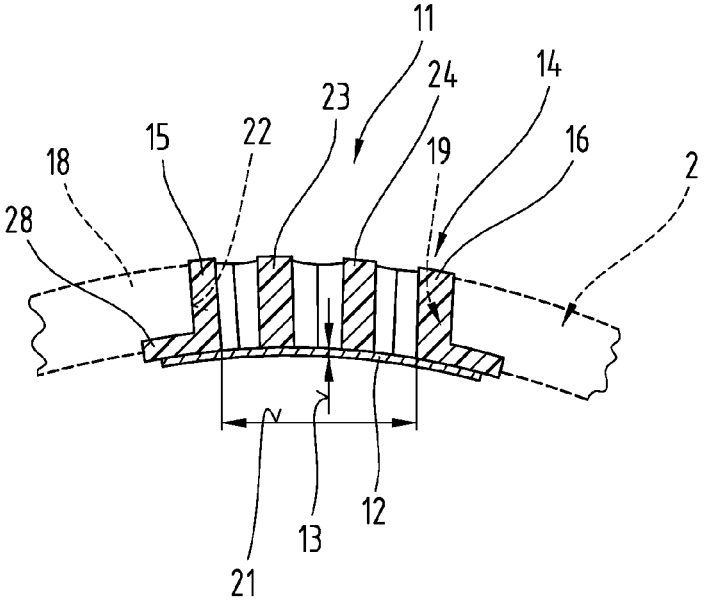
FIG. 4 is the membrane element illustrated in FIG. 3, viewed in section along line IV-IV indicated in FIG. 3, with a shell portion of a sports shoe indicated by broken lines.

As may best be seen from FIGS. 3 and 4 in conjunction with FIG. 1 respectively FIG. 2, the membrane element 11 comprises at least one membrane skin 12, which is decisively responsible for the elastic flexibility in portion 10 of the sports shoe 1. This membrane skin 12 is relatively slack compared with the plastic of the shell 2 and can be relatively easily deflected and deformed.

A membrane skin 12 with a high flexibility and a high ability to change shape can be achieved by opting for a film or textile. A thickness 13 of the membrane skin 12 is usually less than 1 mm. In the case of a textile or woven-type membrane skin 12, its thickness 13 may be less than 0.5 mm, in which case the membrane skin 12 has a high degree of flexibility and ability to change shape whilst nevertheless having sufficient resistance to tearing.

The intrinsically flexible and relatively slack membrane skin 12 is preferably provided with a support body 14, which holds the membrane skin 12 and defines a defined initial or non-operating shape for the membrane skin 12. In this respect, it is of practical advantage if the support body 14 is of a frame-type design and the membrane skin 12 extends at least between outer or externally extending frame portions 15, 16 of the support body 14. This means that the membrane skin 12 is retained on the preferably frame-type support body and is attached in a membrane-type arrangement to the externally extending frame portions 15, 16 of the support body 14. The membrane skin 12 may be tensed on the support body 14 or alternatively may be secured to the support body 14, in particular its frame portions 15, 16 in a relatively loose arrangement or without any intrinsic tensioning. In other words, the membrane skin 12 extends in a relatively slack arrangement, in particular with extra material between the outer frame portions 15, 16 of the support body 14 and/or is elastically stretchable. Accordingly, it is possible to opt for a membrane skin 12 with a combination of slackness and elastic stretching capacity. In particular, during the initial phase of a movement of the membrane skin 12, use can be made of the slackness or the extra material in the lengthways or widthways direction, and during a subsequent phase of a movement 20 of the membrane skin 12, use can also be made of the material elasticity of the membrane skin 12 to obtain a variable width or volume in the interior of the sports shoe 1.

Figure 5:
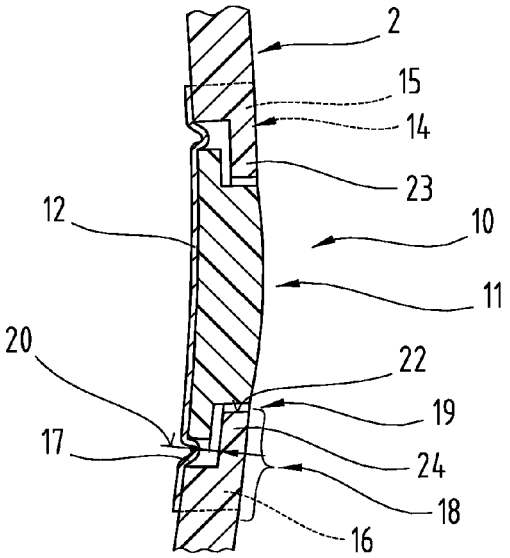
FIG. 5 is a schematic diagram in section illustrating another embodiment of a membrane element in the portion merging into shell parts of a sports shoe.

In the case of one advantageous embodiment illustrated in FIG. 5 respectively 6, the membrane skin 12 has at least one expansion fold 17, by means of which the membrane skin 12 is fitted so that it is able to move relative to the support body 14 and shell 12. The support body 14 for the membrane skin 12 may also be an integral part of the shell 2, as may be seen from FIG. 5. In particular, the support body 14 may be provided in the form of peripheral portions 18, above all by a peripheral portion 18 extending circumferentially around an opening 19 in the shell 2 essentially coinciding with the membrane element 11.

Figure 6:
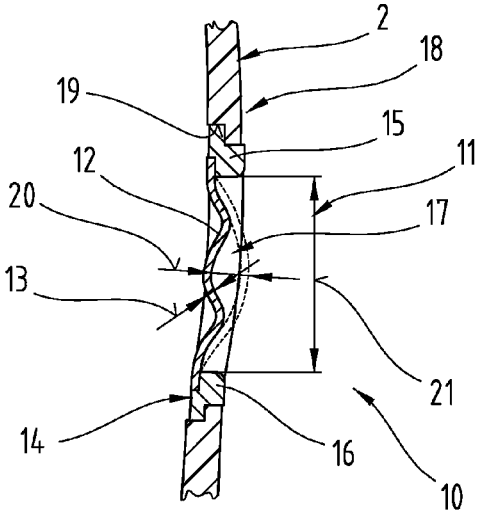
FIG. 6 is a diagram in cross-section illustrating a different embodiment of a membrane element for a sports shoe with a hard shell.

An adequate displacement distance 20 of the membrane skin 12 or membrane element 11 can expediently be achieved if the membrane skin 12 is secured to oppositely lying frame portions 15,16 of the support body 14 or shell 2 so that it is cambered (FIG. 4) or waved (FIG. 6) as viewed in cross-section. In other words, this shape or extra material length means that the stretched length of the membrane skin 12 is bigger than a clearance width 21 between the oppositely lying frame portions 15, 16 or between oppositely lying boundary edges 22 of the opening 19 in the shell 2. In particular, the membrane skin 12 can be made to move quite easily relative to the shell 2 or relative to an integral or structurally separate support body 14 by providing at least one camber or at least one expansion fold 17 in the membrane skin 12 without it being necessary to place increased stress on the membrane skin 12, in particular without elastically stretching the membrane skin 12.

Based on another advantageous embodiment, at least one support element 23, 24 for the membrane skin 12 is provided on at least one frame portion 15, 16. This at least one support element 23, 24 affords an elastically flexible resistance to counter a movement of the membrane skin 12 relative to the support body 14 or relative to the shell 2 and causes the at least one support element 23 to restrict the displacement distance 20 of the membrane element 11 or membrane skin 12. In the case of the embodiment illustrated in FIGS. 3 and 4, the at least one support element 23, 24 supports the membrane skin 12 already on assuming the illustrated initial or non-operating position and thus causes the at least one support element 23, 24 to afford an elastically flexible resistance within the displacement distance 20 of the membrane skin 12. By contrast, the at least one support element 23, 24 of the embodiment illustrated in FIG. 5 restricts the displacement distance 20 of the membrane skin 12 or membrane element 11 so that its ability to deflect outwards is limited. This reliably prevents the membrane skin 12 and entire membrane element 11 from being subjected to excessive strain or damage. It would also be possible to opt for a combination of a stop-restricting effect and an elastic supporting effect of the at least one support element 23, 24 relative to the membrane skin 11.

The at least one support element 23, 24 may extend continuously between oppositely lying frame portions 15,16 of the membrane element 11, as schematically illustrated in FIG. 2 by way of example. The respective support elements 23, 24 in conjunction with the support body 14 define a lattice-type or grill-type structure, which provides support and thus prevents excessive strain on the membrane skin 12 on the one hand and minimises the risk of damage to the membrane skin 12 if the sports shoe 1 is exposed to pointed or sharp objects due to an external pressure or impact force on the other hand.

The at least one support element 23, 24 for the membrane skin 12 may also be designed so that it extends from at least one frame portion 15, 16 of the support body 14 or from the peripheral portion 18 of the membrane element 11 in tongues or fingers in the direction towards the centre region or in the direction towards the middle of the membrane skin 12 or support body 14. Support elements 23, 24 for the membrane skin based on the tongue or finger design are illustrated by way of example in FIG. 3 whereas in FIG. 5, web-type or flange-type support elements 23, 24 are disposed around the shell opening or around the opening 19 for the membrane element 11 and primarily define a stop restriction which prevents excessive strain or detrimentally long displacement distances 20.

The membrane skin 12 may be an extruded or injection moulded layer and may be made from a heat-deformable or elastomeric plastic. Optionally, the membrane skin 12 may also incorporate reinforcing layers or nets, lattices and/or other reinforcing means.

Figure 7:
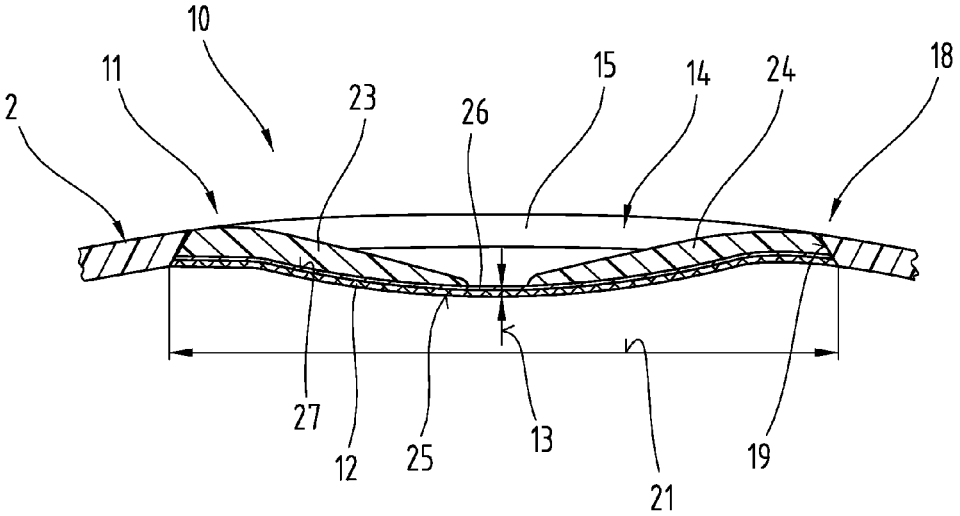
FIG. 7 is a schematic cross-section illustrating another embodiment of a membrane element for reducing pressure points, which constitutes a part-portion of the outer plastic-shell of a sports shoe.

Based on one advantageous embodiment, the membrane skin 12 is provided in the form of a woven fabric 25 made from natural or synthetic yarns or a combination of natural and synthetic yarns. The woven fabric 25 may therefore incorporate plastic yarns and/or carbon fibres in order to obtain a high degree of flexibility on the one hand and a high resistance to tearing on the other hand. As may best be seen from FIG. 7, the membrane skin 12, in particular the corresponding woven fabric 25, is provided with a gas-impermeable and/or liquid-impermeable coating 26. This coating 26 may be made from heat-deformable or elastomeric plastics on at least one flat face 27 of the membrane skin 12 or woven fabric 25. The coating 26 on the one hand seals the shoe interior to prevent ingress by moisture from outside. This gas-impermeable or liquid-impermeable coating 26 is especially practical in the case of a membrane skin 12 provided in the form of a woven fabric 25 because this type of sports shoe 1 is often used in snow or wet conditions.

It is of particular practical advantage to provide a coating 26 of heat-deformable plastic and to apply it to the flat face 27 of the membrane skin 12 directed towards the support body or frame portions 15, 16. It is likewise of practical advantage to apply the coating 26 of plastic to the flat face 27 of the membrane skin 12 lying closest to the tongue-type or web-type support element 23, 24. The coating 26 may be applied by spraying or coating at least one flat face 27 of a woven membrane skin 12 over its entire surface. In addition to improving the sealing function of the membrane skin 12, an improved join can also be obtained between the membrane skin 12 and a support body of plastic for the membrane skin 12. In particular, the membrane skin 12 and support body 14 may be adhesively joined to one another by a plastic injection moulding process, in which case the plastic-coating 26 produces a particularly firm and tear-resistant join between these elements on at least one flat face 27 of the membrane skin 12. This offers a particularly simple way of injection moulding a frame-type support body 14, optionally together with at least one web-type or finger-type support element 23, 24, onto an appropriately thin membrane skin 12 by means of a plastic injection moulding process. The plastic-coating 26 and the plastic of the support body 14 or support elements 23, 24 at least partially fuse with one another, causing these plastics to melt, thereby further increasing the robustness of the membrane element 11. The coated membrane skin 12 and the support body 14 and its support elements 23, 24 are welded to one another, so to speak, by the plastic injection moulding process.

Extra robustness can also be achieved if the at least one support element 23, 24 extends in a tongue pattern or finger pattern in the direction towards the central region of the coated membrane skin 12. This will specifically ensure that the membrane skin 12 is retained on the at least one support element 23,24 or outer frame portion 15 without undesirably tearing off, as may best be seen from FIG. 7.

The membrane skin 12 as such may optionally be provided in the form of a sealing membrane. In this case, the membrane skin 12 is expediently provided in the form of an elastically stretchable and rebounding layer of plastic, in particular elastomer.

As may best be seen from FIG. 3 in conjunction with FIG. 4, it is of practical advantage to provide at least one flange-type peripheral portion 28 on the membrane element 11, in particular a flange-type peripheral portion 28 extending around the outer frame portions 15, 16, which is joined to the peripheral portion 18 in order to provide an opening 19 in the shell 2 corresponding to the membrane element 11. As viewed in cross-section, therefore, the support body 14 or at least an outer frame portion 15, 16 of the support body 14 may have an L-shaped contour in cross-section.

As may also best be seen from FIGS. 3, 4 respectively 7, it is particularly practical if the membrane element 11 is a prefabricated component. The membrane element 11 in the form of a prefabricated part-component is then injected around certain portions of the plastic of the shell 2 during the course of manufacturing the sports shoe 1, as illustrated in FIGS. 1, 2 in conjunction with FIG. 4, 6 or 7. This offers an easy way of producing sports shoes 1 which have a membrane element 11 of the type described above on the inside and/or outside of the shell 2. Such a membrane element 11 is preferably disposed in the region of the metatarsal bone or base of the toe bones (FIGS. 1, 2) and/or in the region of the ankle or ankle joint.

As illustrated by the portions 10 shown in broken lines in FIGS. 1, 2, a corresponding membrane element 11 may also be provided in the region of the instep to make it easier to step in and out of the sports shoe 1. Alternatively or in combination with this, a correspondingly more flexible portion 10 may also be provided in the region of the navicular bone (FIG. 2) on the shoe inside and/or in the region of the heel (FIGS. 1, 2), given that there is likewise a more bony projection of the foot here.

In terms of extension and effect, another advantageous embodiment is one in which the membrane element 11 has an oval or egg-shaped contour, as schematically illustrated by way of example in FIGS. 1 to 3.

The embodiments illustrated as examples represent possible variants of the sports shoe 1 and membrane element 11, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the sports shoe 1 and membrane element 11, they and their constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1; 2; 3, 4; 5; 6; 7 constitute independent solutions proposed by the invention in their own right. The objectives and associated solutions proposed by the invention may be found in the detailed descriptions of these drawings.

The invention claimed is:

1. A sports shoe with an outer shell of injection moulded plastic, comprising:

a front foot shell for accommodating a front part of a foot;

an adjoining shoe cuff for stabilising a lower leg portion of a user;

a relatively flexible inner shoe at least partially accommodated in the outer shell; and at least one elastically flexible portion is a cut-out in the outer shell above the sole of the shoe to reduce pressure points from the inner shoe on a user's foot on exposure to compression stress, the outer shell including an inner surface and an outer surface separated by a thickness of the outer shell, wherein the inner surface is arranged towards the relatively flexible inner shoe;

wherein the elastically flexible portion is provided in the form of at least one membrane element that receives compression stress and is designed to vary a volume or width which the outer shell can accommodate as a function of compression load due to its slackness or ability to deflect relative to surrounding part-portions of the outer shell, wherein the membrane element comprises:

a membrane skin that is at least partially elastic and includes at least one expansion fold which allows for a displacement of the membrane skin by a distance of between about 3 mm and 6 mm in a direction perpendicular to the thickness of the outer shell; and a support body for the membrane skin, wherein the support body includes a frame portion and the membrane skin is arranged on the support body such that the membrane skin is located on the inner surface of the outer shell and extends between outer or externally extending frame portions of the support body.

2. The sports shoe as claimed in claim 1, wherein the membrane skin extends in a slack arrangement between the outer frame portions of the support body.

3. The sports shoe as claimed in claim 1, wherein the at least one expansion fold allows the membrane skin to be fitted so that the membrane skin is able to move relative to the support body.

4. The sports shoe as claimed in claim 1, wherein the membrane skin is attached to oppositely lying frame portions of the support body in a cambered or waved arrangement as viewed in cross-section, and a stretched length of the membrane skin is bigger than a clearance width between the oppositely lying frame portions.

5. The sports shoe as claimed in claim 1, wherein the support body for the membrane skin is provided on at least one frame portion, which affords an elastically flexible resistance to a movement of the membrane skin relative to the support body and/or affords a resistance to limit the displacement distance of the membrane skin.

6. The sports shoe as claimed in claim 5, wherein the at least one frame portion extends continuously between oppositely lying frame portions or extends out from at least one frame portion in a tongue pattern or finger pattern in the direction towards the central region of the support body.

7. The sports shoe as claimed in claim 1, wherein the membrane skin is provided in the form of a woven fabric made from natural or synthetic yarns.

8. The sports shoe as claimed in claim 1, wherein the membrane skin is provided with a gas-impermeable and/or liquid-impermeable coating.

9. The sports shoe as claimed in claim 8, wherein the coating is made from plastic and is disposed on a flat face directed towards the frame portions or is applied to the flat face of the membrane skin lying closest to at least one tongue-type or web-type support element.

10. The sports shoe as claimed in claim 1, wherein the membrane skin is a film and is formed by at least one plastic or woven fabric layer which is adhesively joined to the support body by a plastic injection moulding process.

11. The sports shoe as claimed in claim 10, wherein the support body is injected onto a flat face of the membrane skin.

12. The sports shoe as claimed in claim 1, wherein the membrane skin is provided in the form of a sealing membrane and is an elastically stretchable and rebounding layer of plastic, in particular elastomer.

13. The sports shoe as claimed in claim 1, wherein the membrane element has at least one flange-type peripheral portion for joining to a peripheral portion around a corresponding opening in the outer shell.

14. The sports shoe as claimed in claim 1, wherein the membrane element is a prefabricated component, which is injected around a portion of the plastic of the outer shell during a process of manufacturing the sports shoe from plastic, the portion of the plastic of the outer shell around which the membrane element is injected selected from the group consisting of: the portion corresponding to a metatarsal bone; the portion corresponding to a base of toe bones; the portion corresponding to an ankle; and the portion corresponding to an ankle joint.

15. The sports shoe as claimed in claim 1, wherein the membrane element is of an elongate, in particular oval or egg-shaped, design and is disposed on the inside and/or outside of the shell in the region of the metatarsal bone or base of the toe bones and/or in the region of the ankle or ankle joint.

* * * * *